US012179065B2

(12) United States Patent
Madson et al.

(10) Patent No.: US 12,179,065 B2
(45) **Date of Patent: *Dec. 31, 2024**

(54) DIMPLE PATTERNS FOR GOLF BALLS

(71) Applicant: Acushnet Company, Fairhaven, MA (US)

(72) Inventors: Michael Madson, Easton, MA (US); Nicholas Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/743,743

(22) Filed: May 13, 2022

(65) Prior Publication Data

US 2022/0266096 A1 Aug. 25, 2022

Related U.S. Application Data

(63) Continuation of application No. 16/953,540, filed on Nov. 20, 2020, now Pat. No. 11,406,876.

(51) Int. Cl.
*A63B 37/06* (2006.01)
*A63B 37/00* (2006.01)

(52) U.S. Cl.
CPC ..... *A63B 37/0006* (2013.01); *A63B 37/0012* (2013.01); *A63B 37/002* (2013.01); *A63B 37/0021* (2013.01); *A63B 37/0019* (2013.01)

(58) Field of Classification Search
CPC ..... A63B 37/0006
USPC ..... 473/378
See application file for complete search history.

(56) References Cited

U.S. PATENT DOCUMENTS

| | | | | |
|---|---|---|---|---|
| 5,158,300 | A | 10/1992 | Aoyama | |
| 5,688,194 | A | 11/1997 | Stiefel et al. | |
| 6,729,976 | B2 | 5/2004 | Bissonnette et al. | |
| 6,796,912 | B2 | 9/2004 | Dalton et al. | |
| 7,048,652 | B2 | 5/2006 | Sato et al. | |
| 7,503,856 | B2 | 3/2009 | Nardacci et al. | |
| 7,951,017 | B2 | 5/2011 | Umezawa | |
| 8,821,317 | B2 | 9/2014 | Umezawa | |
| 9,782,630 | B2 | 10/2017 | Madson et al. | |
| 9,839,813 | B2 | 12/2017 | Squires et al. | |
| 10,183,195 | B2 | 1/2019 | Madson et al. | |
| 10,814,179 | B1 | 10/2020 | Madson | |
| 11,045,692 | B2 | 6/2021 | Madson | |
| 11,406,876 | B2 * | 8/2022 | Madson | A63B 37/002 |
| 2003/0080469 | A1 | 5/2003 | Endo et al. | |
| 2007/0049423 | A1 * | 3/2007 | Nardacci | A63B 37/0021 473/378 |

(Continued)

*Primary Examiner* — Raeann Gorden
(74) *Attorney, Agent, or Firm* — Bradley Arant Boult Cummings LLP

(57) ABSTRACT

Golf balls having dimple patterns arranged in dipyramid layouts are disclosed. The patterns may be arranged in triangular dipyramid, quadrilateral dipyramid, pentagonal dipyramid, or hexagonal dipyramid layouts. The dipyramid patterns have six, eight, ten, or twelve substantially identical dimple sections, where each dimple section is defined by a spherical triangle. The dimples in each of the identical dimple sections have at least two different dimple diameters including a minimum dimple diameter and a maximum dimple diameter. The resulting dimple patterns have a surface coverage of about 70 percent or less. The reduced surface coverage helps to reduce the flight of the golf balls.

19 Claims, 11 Drawing Sheets

(56) References Cited

U.S. PATENT DOCUMENTS

| | | | | |
|---|---|---|---|---|
| 2009/0023519 | A1 | 1/2009 | Sullivan et al. | |
| 2011/0065531 | A1 | 3/2011 | Goodwin | |
| 2013/0172123 | A1 | 7/2013 | Nardacci et al. | |
| 2014/0364253 | A1* | 12/2014 | Sullivan | C08K 5/098 473/376 |
| 2016/0051861 | A1* | 2/2016 | Nardacci | A63B 37/0004 473/378 |
| 2018/0311533 | A1* | 11/2018 | Madson | A63B 37/002 |
| 2019/0168076 | A1* | 6/2019 | Nardacci | A63B 37/0004 |

* cited by examiner

DIMPLE PATTERNS FOR GOLF BALLS

FIELD OF THE INVENTION

The present disclosure relates generally to golf balls. More particularly, the present disclosure relates to golf ball dimple patterns that are arranged in dipyramid layouts and have low surface coverages.

BACKGROUND OF THE INVENTION

The flight performance of a golf ball is affected by a variety of factors including the weight, size, materials, dimple pattern, and external shape of the golf ball. Golf ball manufacturers seek to maximize aerodynamic efficiency and improve the performance of golf balls by adjusting the materials and construction of the ball as well as the dimple pattern and dimple shape.

The aerodynamic forces acting on a golf ball are typically resolved into orthogonal components of lift ($F_L$) and drag ($F_D$). Lift is defined as the aerodynamic force component acting perpendicular to the flight path. It results from a difference in pressure that is created by a distortion in the air flow that results from the back spin of the ball. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Drag is defined as the aerodynamic force component acting parallel to the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. The air separates from the surface of the ball, leaving a large turbulent flow area with low pressure, i.e., the wake. The difference between the high pressure in front of the ball and the low pressure behind the ball reduces the ball speed and acts as the primary source of drag.

Recently, there has been an increased desire to manipulate these aerodynamic forces to produce reduced-flight golf balls (i.e., golf balls that are designed to travel a distance that is shorter than the distance traveled by standard golf balls). Advances in golf ball compositions and dimple designs have caused high-performance golf balls to exceed the maximum distance allowed by the United States Golf Association (USGA). Some industry experts have called for the USGA to roll back the distance standard for golf balls to preserve the game.

Golf ball manufacturers have developed ways to reduce the distance traveled by the golf ball. For example, some manufacturers have created inefficient dimple patterns or have modified the compositions of the golf ball core to reduce the flight of the ball. Inefficient dimple patterns with low surface coverages have been used for many years. For example, the Atti pattern, which is an octahedron pattern split into eight concentric straight-line rows and covering 66 percent of the ball, was the predominant pattern utilized on golf balls for most of the $20^{th}$ century. These dimple patterns were composed of substantially uniform dimples (for example, dimples having only one or two dimple diameters) and lacked aerodynamic efficiency. As dimple designers moved toward patterns with increased surface coverages, many more dimple sizes (for example, dimple diameters) were needed to achieve increased coverages and improved aerodynamics, such as increased distance. While these high-performance golf balls have improved aerodynamic consistency, the golf balls will not adhere to a shorter USGA maximum distance.

Accordingly, there remains a need to fine-tune the dimple patterns and dimple dimensions on these high-performance golf balls to reduce the flight distance, while also maintaining the appearance of a high-performance trajectory.

SUMMARY OF THE INVENTION

High-performance golf balls having reduced flight distance are disclosed. In some embodiments, the present disclosure provides a golf ball having a substantially spherical surface, including a plurality of dimples disposed thereon, wherein the dimples are arranged in a dipyramid pattern including six, ten, or twelve substantially identical dimple sections, wherein each dimple section is defined by a spherical triangle, wherein the dimples in each of the substantially identical dimple sections include at least two different dimple diameters including a minimum dimple diameter and a maximum dimple diameter, and wherein the dimples cover about 70 percent or less of the substantially spherical surface, and wherein the pattern results in one dimple free great circle on the golf ball.

In this embodiment, the dipyramid pattern includes a triangular dipyramid pattern, a pentagonal dipyramid pattern, or a hexagonal dipyramid pattern. In another embodiment, each of the at least two different dimple diameters range from about 0.030 inches to about 0.200 inches. In still another embodiment, the pattern has mirror symmetry about a central plane of each substantially identical dimple section. In yet another embodiment, the dimples each have a corresponding edge angle and the average of all the edge angles ($\theta_\mu$) is related to the surface coverage according to equation (III):

$$88.8(SC)^2 - 116.9(SC) + 47.7 \le \theta_\mu \le 170.0(SC)^2 - 242.5(SC) + 106.6, \quad \text{(III)}$$

where SC is the surface coverage. In another embodiment, each substantially identical dimple section includes at least one shared dimple, the shared dimple having a centroid that intersects a side edge of the dimple section.

In other embodiments, a golf ball having a substantially spherical surface, including a plurality of dimples disposed thereon, wherein the dimples are arranged in a dipyramid pattern selected from the group consisting of triangular dipyramid, quadrilateral dipyramid, pentagonal dipyramid, and hexagonal dipyramid, the dipyramid pattern including six, eight, ten, or twelve substantially identical dimple sections, wherein each dimple section is defined by a spherical triangle having three vertices, wherein the dimples in each of the substantially identical dimple sections have a corresponding dimple diameter and a corresponding edge angle, wherein the dimples in each of the substantially identical dimple sections include (i) at least three different dimple diameters including a minimum dimple diameter, a maximum dimple diameter, and at least one additional dimple diameter, wherein each of the at least three different dimple diameters range from about 0.030 inches to about 0.200 inches, and (ii) substantially identical edge angles, and wherein the dimples cover about 60 percent or less of the substantially spherical surface.

In this embodiment, each substantially identical dimple section includes at least one shared dimple, the shared dimple having a centroid that intersects a side edge of the dimple section. In another embodiment, a dimple is located at a single vertex of the dimple section. In still another embodiment, the pattern results in one dimple free great circle on the golf ball. In yet another embodiment, the average of all the edge angles ($\theta_\mu$) is related to the surface coverage according to equation (III):

$$88.8(SC)^2 - 116.9(SC) + 47.7 \leq \theta_\mu \leq 170.0(SC)^2 - 242.5(SC) + 106.6, \quad \text{(III)}$$

where SC is the surface coverage. In another embodiment, the maximum difference in diameter between any two dimples within each dimple section is about 0.080 inches or less. In still another embodiment, the pattern has mirror symmetry about a central plane of each substantially identical dimple section.

In still other embodiments, a golf ball having a substantially spherical surface, including a plurality of dimples disposed thereon, wherein the dimples are arranged in a dipyramid pattern selected from the group consisting of triangular dipyramid, quadrilateral dipyramid, pentagonal dipyramid, and hexagonal dipyramid, the dipyramid pattern comprising six, eight, ten, or twelve substantially identical dimple sections, wherein each dimple section is defined by a spherical triangle, wherein the dimples in each of the substantially identical dimple sections have a corresponding dimple diameter and a corresponding edge angle, wherein the dimples in each of the substantially identical dimple sections include five or more different dimple diameters including a minimum dimple diameter, a maximum dimple diameter, and at least three additional dimple diameters, wherein each of the five or more different dimple diameters range from about 0.030 inches to about 0.180 inches and differ by more than 0.005 inches, wherein the dimples cover about 50 percent or less of the substantially spherical surface and the pattern results in one dimple free great circle on the golf ball.

In one embodiment, the dimples in each of the substantially identical dimple sections include substantially identical edge angles. In another embodiment, the average of all the edge angles ($\theta_\mu$) is related to the surface coverage according to equation (III):

$$88.8(SC)^2 - 116.9(SC) + 47.7 \leq \theta_\mu \leq 170.0(SC)^2 - 242.5(SC) + 106.6, \quad \text{(III)}$$

where SC is the surface coverage. In still another embodiment, the dimples are arranged entirely within each of the substantially identical dimple sections. In yet another embodiment, each substantially identical dimple section includes at least one shared dimple, the shared dimple having a centroid that intersects a side edge of the dimple section. In another embodiment, the dimples cover about 30 percent or less of the substantially spherical surface. In still another embodiment, the pattern has mirror symmetry about a central plane of each substantially identical dimple section.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
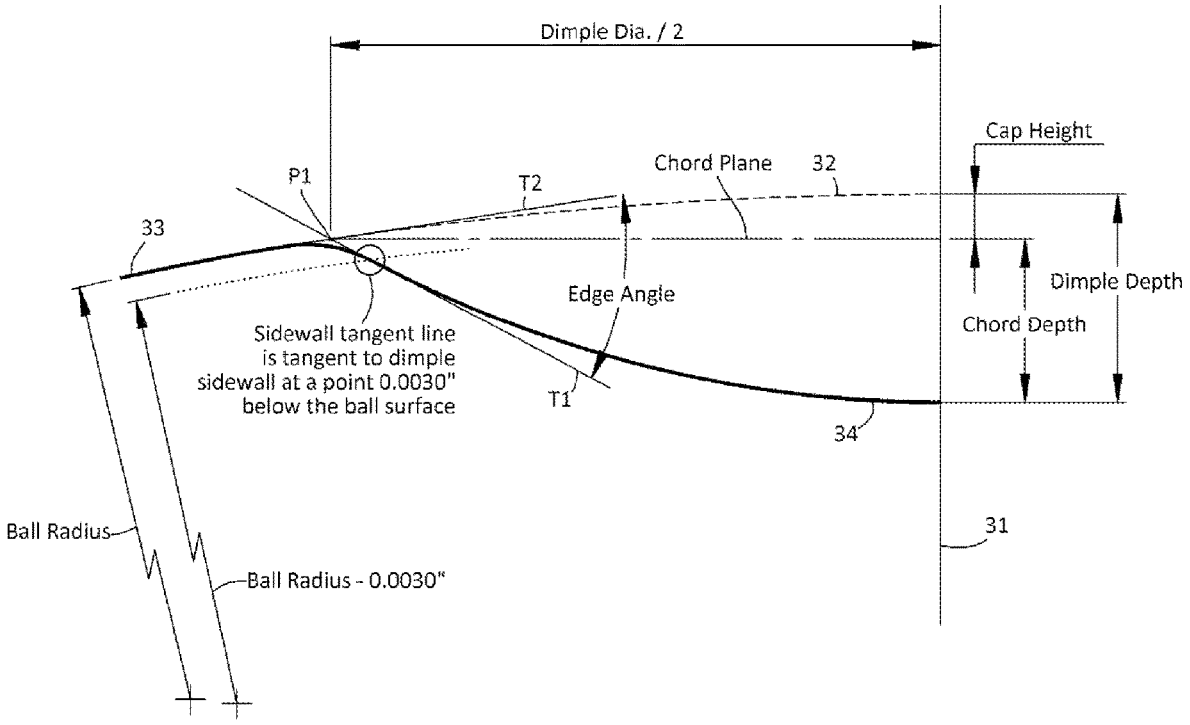
FIG. 1 is a schematic diagram illustrating a method for measuring the diameter of a dimple.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The present disclosure provides reduced-flight golf balls. That is, golf balls designed to travel a distance that is shorter than the distance traveled by current performance balls. The golf balls of the present disclosure have low dimple surface coverage and dimple patterns composed of multiple dimple sizes and edge angles that correlate with the surface coverage. Advantageously, by using multiple dimple sizes, for instance, different dimple diameters, edge angles, and dimple depths, the dimple patterns disclosed herein can be optimized to help reduce the flight of the ball while providing improved aerodynamic consistency and maintaining the appearance of a high-performance trajectory.

Dimple Arrangement

The golf ball dimple patterns of the present disclosure are arranged in dipyramid layouts. According to the dipyramid layouts, there are two identical hemispheres on the golf ball separated by an equator. Each hemisphere may include three, four, five, or six triangular segments such that there are six, eight, ten, or twelve identical sections, respectively, on the golf ball. In one embodiment, each section is in the shape of a spherical triangle. As used herein, "spherical triangle" refers to a figure formed on the surface of a sphere by three circular arcs intersecting pairwise at three vertices. The three circular arcs each represent an edge of the spherical triangle. In some embodiments, each spherical triangle has a base edge located at the equator of the golf ball and two side edges that run longitudinally from the base edge to the pole of the hemisphere. A spherical triangle in the northern hemisphere may be joined with a spherical triangle in the southern hemisphere at their base edges to form a "dipyramid."

In one embodiment, the golf ball dimple patterns may be arranged in a triangular dipyramid layout such that there are three spherical triangles on each of the two hemispheres of the golf ball. In this embodiment, the triangular dipyramid layout includes a total of six identical dimple sections on the golf ball. In another embodiment, the golf ball dimple patterns may be arranged in a quadrilateral dipyramid layout such that there are four spherical triangles on each of the two hemispheres of the golf ball. In this embodiment, the quadrilateral dipyramid layout includes a total of eight identical dimple sections on the golf ball. In still another embodiment, the golf ball dimple patterns may be arranged in a pentagonal dipyramid layout such that there are five spherical triangles on each of the two hemispheres of the golf ball. In this embodiment, the pentagonal dipyramid layout includes a total of ten identical dimple sections on the golf ball. In yet another embodiment, the golf ball dimple patterns may be arranged in a hexagonal dipyramid layout such that there are six spherical triangles on each of the two hemispheres of the golf ball. In this embodiment, the hexagonal dipyramid layout includes a total of twelve identical dimple sections on the golf ball.

In one embodiment, the dimples may be located entirely within a dimple section. For example, the dimples may be arranged within the edges of the spherical triangle such that no dimples intersect an edge of the spherical triangle. In another embodiment, dimples may be shared between two or more dimples sections. In one aspect of this embodiment, for each dimple that is not located entirely within a dimple section, the centroid of the dimple is located along a side edge or at one or more vertices of the spherical triangle. In another aspect of this embodiment, dimples shared between two sections may include dimples that are positioned such that the centroid of the dimple does not lie along a side edge. For purposes of the present disclosure, the "centroid" of the dimple refers to the center of the dimple. In other embodiments, the base edges of the dimple sections are defined such that no dimples intersect the base edge.

In one embodiment of the present invention, the dimple pattern within each of the dimple sections may be arranged such that one or more dimples intersect a side edge of the spherical triangle. In a particular aspect of this embodiment, the side edge intersected by the one or more dimples runs through the centroid of the dimple such that half of the dimple is located within one spherical triangle and the other half is located within another spherical triangle. In another aspect of this embodiment, the side edge intersected by one or more dimples does not run through the centroid of the dimple. That is, less than half of the dimple is located within one spherical triangle and more than half of the dimple is located within an adjacent spherical triangle. In one embodiment, the dimple pattern within each of the dimple sections includes at least three dimples that intersect a side edge of the spherical triangle. In another embodiment, the dimple pattern within each of the dimple sections includes at least six dimples that intersect a side edge of the spherical triangle. In another embodiment, the dimple pattern within each of the dimple sections includes at least twelve dimples that intersect a side edge of the spherical triangle. In another embodiment, the dimple pattern within each of the dimple sections includes at least fifteen dimples that intersect a side edge of the spherical triangle.

In another embodiment, the dimple patterns of the present disclosure may be arranged such that a dimple lies at one or more vertices of the spherical triangle. In this embodiment, the centroid of the dimple is located at the vertex of the spherical triangle and a portion of the dimple is located within the other spherical triangles. That is, the dimple located at the vertex of the spherical triangle may be centered on the vertices of the spherical triangles. The dimple patterns of the present disclosure may include a dimple located at a single vertex of the spherical triangle. In another embodiment, the dimple patterns may include a dimple located at each of two vertices of the spherical triangle. In still another embodiment, the dimple patterns may include a dimple located at each of the three vertices of the spherical triangle.

The dimple patterns arranged in each of the dimple sections, for example, in each of the spherical triangles, are substantially identical to each other. For purposes of the present disclosure, dimple patterns are "substantially identical" if they have substantially the same dimple arrangement (i.e., the relative positions of each of the dimples' centroids are about the same) and substantially the same dimple characteristics (e.g., plan shape, cross-sectional shape, diameter, edge angle). Thus, for each dimple located entirely within a particular dimple section, for example, a particular spherical triangle, there is a corresponding dimple in each of the other dimple sections. For dimples having a centroid located along an edge of the dimple section, there is a corresponding dimple located along the same edge in the other dimple sections. For dimples located at the one or more vertices of the dimple sections, these dimples are shared between the other dimple sections.

The dimple patterns within each dimple section, for example, within each spherical triangle, include dimples having varying dimple diameters. In one embodiment, each dimple pattern has at least two different dimple diameters, including a minimum diameter dimple and a maximum diameter dimple. For example, the triangular and hexagonal dipyramid layouts disclosed herein may include dimple patterns having at least two different dimple diameters. For purposes of the present disclosure, dimples having substantially different diameters include dimples on a finished ball having respective diameters that differ by 0.005 inches or more. In another embodiment, each dimple pattern has at least three different dimple diameters, including a minimum diameter dimple, a maximum diameter dimple, and at least one additional diameter dimple. For instance, the quadrilateral and pentagonal dipyramid layouts disclosed herein may include dimple patterns having at least three different dimple diameters. In another embodiment, each dimple pattern has at least four different dimple diameters, including a minimum diameter dimple, a maximum diameter dimple, and at least two additional diameter dimples. In still another embodiment, each dimple pattern has at least five different dimple diameters, including a minimum diameter dimple, a maximum diameter dimple, and at least three additional diameter dimples. In yet another embodiment, each dimple pattern has at least six different dimple diameters, including a minimum diameter dimple, a maximum diameter dimple, and at least four additional diameter dimples. In still another embodiment, each dimple pattern has at least seven different dimple diameters, including a minimum diameter dimple, a maximum diameter dimple, and at least five additional diameter dimples.

As discussed above, in some embodiments, the dimple pattern includes at least one dimple intersecting a side edge of the dimple section. In this embodiment, at least one dimple having the minimum dimple diameter intersects the side edge of the dimple section. In another embodiment, at least one dimple having the maximum dimple diameter intersects the side edge of the dimple section. In still another embodiment, at least one dimple having neither the minimum nor maximum dimple diameter intersects the side edge of the dimple section. Additionally, in some embodiments, the dimple pattern includes at least one dimple lying at a vertex of the dimple section. In one embodiment, at least one dimple having the maximum dimple diameter is located at a vertex of the dimple section. In another embodiment, at least one dimple having the minimum dimple diameter is located at a vertex of the dimple section. In still another embodiment, at least one dimple having neither the minimum nor maximum dimple diameter is located at a vertex of the dimple section.

In one embodiment, the dimple patterns disclosed herein may be symmetric. For example, the dimple patterns within each dimple section may be rotationally symmetric about the central point of each dimple section. That is, the dimple patterns may have three-way rotational symmetry about an axis connecting the center of the golf ball and the central point of the dimple section. In another embodiment, the dimple patterns may have mirror symmetry about a central plane of each dimple section, where the central plane is a plane containing the center of the golf ball, the central point of the corresponding dimple section, and one vertex of the corresponding dimple section. In still other embodiments, the dimple patterns disclosed herein are not rotationally symmetric. For example, the triangular and hexagonal dipyramid dimple patterns may not be rotationally symmetric about the central point of each dimple section.

In one embodiment, the dimples should be arranged within each dimple section such that the outer surface of the golf ball has dimple free great circles. A golf ball having a "dimple free great circle" refers to a golf ball having an outer surface that contains a great circle which does not intersect any dimples. In mathematical terms, every dimple free great circle follows a path on the surface of a golf ball having a given width, and within the given width, there exists an infinite number of great circles. However, for purposes of the present disclosure, each dimple free great circle traverses a different dimple free path in the dimple pattern than another dimple free great circle.

In one embodiment, the dimples may be arranged within each dimple section such that there are more than three dimple free great circles on the outer surface of the golf ball. For example, the dimples may be arranged within each dimple section such that there are four dimple free great circles on the outer surface of the golf ball. In other embodiments, the dimples may be arranged within each dimple section such that there is one dimple free great circle on the outer surface of the golf ball. In still other embodiments, the dimples may be arranged within each dimple section such that there are no dimple free great circles on the outer surface of the golf ball.

The dimples may be positioned within each dimple section according to any packing method known in the art so long as the dimple sections are substantially identical and meet the symmetry and surface coverage requirements discussed herein. For example, the dimples may be arranged within each dimple section according to the methods described in U.S. Pat. No. 10,183,195, issued on Jan. 22, 2019; U.S. Pat. No. 7,503,856, issued on Mar. 17, 2009; pending U.S. application Ser. No. 16/587,298, filed on Sep. 30, 2019; and pending U.S. application Ser. No. 16/587,321, filed on Sep. 30, 2019, the entire disclosures of which are incorporated herein by reference.

Dimple Plan Shapes and Profiles

The present disclosure contemplates dimples having a circular plan shape. A "plan shape," as used herein, refers to the perimeter of the dimple as seen from a top view of the dimple, or the demarcation between the dimple and the outer surface of the golf ball or fret surface. However, non-circular plan shapes may also be suitable for use with the present disclosure. For example, the plan shape may be any one of a circle, square, triangle, rectangle, oval, or other geometric or non-geometric shape. In another embodiment, the dimples may have a plan shape defined by low frequency periodic functions or high frequency periodic functions.

In one embodiment, the dimples contemplated for use in the dimple patterns are spherical dimples (i.e., dimples having a circular plan shape and a dimple profile based on a spherical function). A "dimple profile," as used herein, refers to the cross section of the dimple as seen from a side view of the dimple. However, other dimple profile shapes may also be suitable for use with the present disclosure. For example, the dimples may be defined by the revolution of a catenary curve about an axis, such as that disclosed in U.S. Pat. Nos. 6,796,912 and 6,729,976, the entire disclosures of which are incorporated by reference herein. In another embodiment, the dimple profiles may correspond to ellipses, saucer-shapes, truncated cones, and flattened trapezoids.

In still another embodiment, the dimples may have profiles defined by a continuous function, such as a polynomial function, an exponential function, a trigonometric function, and a hyperbolic function. Specific non-limiting examples of suitable dimple profiles contemplated by the present disclosure include those that can be defined by the following functions: conical, catenary, polynomial, Witch of Agnesi, frequency, Neiles parabola, sine, cosine, hyperbolic sine, and hyperbolic cosine profiles.

The dimple profile may also be defined by combining a spherical curve and a different curve, such as a cosine curve, a frequency curve or a catenary curve, as disclosed in U.S. Patent Publication No. 2012/0165130, which is incorporated in its entirety by reference herein. Similarly, the dimple profile may be defined by a combination of two or more curves. For example, in one embodiment, the dimple profile is defined by combining a spherical curve and a different curve. In another embodiment, the dimple profile is defined by combining a cosine curve and a different curve. In still another embodiment, the dimple profile is defined by combining a frequency curve and a different curve. In yet another embodiment, the dimple profile is defined by combining a catenary curve and a different curve. In still another embodiment, the dimple profile may be defined by combining three or more different curves. In yet another embodiment, one or more of the curves may be a functionally weighted curve, as disclosed in U.S. Patent Publication No. 2013/0172123, which is incorporated in its entirety by reference herein.

Surface Coverage

Dimple patterns generated by the present disclosure can achieve a low percentage of surface coverage. As used herein, "surface coverage" refers to the percentage of the ball surface that has been removed by the formation of dimples. In other words, the surface coverage is the surface area of a sphere having the diameter of the golf ($D_{ball}$) minus the surface area of the fret area of the golf ball. By reducing the surface coverage, the flight and distance of the golf ball can be reduced.

Surface coverage may be calculated using equation (I):

$$\text{Surface Coverage} = \frac{\sum_{i=1}^{n} \pi(r_i^2 + h_i^2)}{4\pi\left(\frac{D_{ball}}{2}\right)^2}, \quad \text{(I)}$$

where n is the number of dimples on the ball, r is the dimple plan shape radius (equal to the dimple diameter/2), and h is the cap height as shown in FIG. 1.

In one embodiment, the dimple patterns generated by the present disclosure have a surface coverage of less than about 70 percent. In another embodiment, the dimple patterns generated by the present disclosure have a surface coverage of less than about 60 percent. In still another embodiment, the dimple patterns generated by the present disclosure have a surface coverage of less than about 50 percent. In yet another embodiment, the dimple patterns generated by the present disclosure have a surface coverage of less than about 40 percent. In another embodiment, the dimple patterns generated by the present disclosure have a surface coverage of less than about 30 percent. In still another embodiment, the dimple patterns generated by the present disclosure have a surface coverage of less than about 20 percent. In yet another embodiment, the dimple patterns generated by the present disclosure have a surface coverage of about 15 percent.

Dimple Dimensions

As discussed above, the dimple patterns within each dimple section, for example, within each spherical triangle, include dimples having at least two different dimple diameters, including a minimum dimple diameter and a maximum dimple diameter. In one embodiment, each dimple has a dimple diameter of about 0.030 inches to about 0.200 inches. In another embodiment, each dimple has a dimple diameter of about 0.050 inches to about 0.180 inches. In still another embodiment, each dimple has a dimple diameter of about 0.070 inches to about 0.160 inches. In yet another embodiment, each dimple has a dimple diameter of about 0.090 inches to about 0.140 inches. In some embodiments, the minimum dimple diameter is less than 0.100 inches. For instance, the minimum dimple diameter may be about 0.030 inches to about 0.100 inches. In another embodiment, the minimum dimple diameter may be about 0.050 inches to about 0.090 inches.

The minimum and maximum differences between any two dimple diameters within a dimple section may vary. In one embodiment, the minimum difference between any two dimple diameters within a dimple section is about 0.030 inches or more. In another embodiment, the minimum difference between any two dimple diameters within a dimple section is about 0.040 inches or more. In other embodiments, the maximum difference between any two dimple diameters within a dimple section is about 0.080 inches or less. In another embodiment, the maximum difference between any two dimple diameters within a dimple section is about 0.065 inches or less. In still another embodiment, the maximum difference between any two dimple diameters within a dimple section is about 0.055 inches or less. In another embodiment, the maximum difference between any two dimple diameters within a dimple section is about 0.045 inches or less. For instance, the difference between any two dimple diameters within each dimple section is about 0.030 inches to about 0.080 inches.

In one embodiment, the dimples contemplated for use in the dimple patterns of the present disclosure have a circular plan shape. However, as noted above, the dimples may also have a variety of other plan shapes. The diameter of a dimple having a non-circular plan shape is defined by its equivalent diameter, $d_e$, which may be calculated according to equation (II):

$$d_e = 2\sqrt{\frac{A}{\pi}}, \quad \text{(II)}$$

where $d_e$ is the equivalent dimple diameter and A is the plan shape area of the dimple. By the term, "plan shape area," it is meant the area based on a planar view of the dimple plan shape, such that the viewing plane is normal to an axis connecting the center of the golf ball to the point of the calculated surface depth. In one embodiment, the equivalent diameters of dimples having non-circular plan shapes are the same as the ranges of dimple diameters discussed above for the circular plan shaped dimples.

Diameter measurements are determined on finished golf balls according to FIG. 1. Generally, it may be difficult to measure a dimple's diameter due to the indistinct nature of the boundary dividing the dimple from the ball's undisturbed land surface. Due to the effect of paint and/or the dimple design itself, the junction between the land surface and dimple may not be a sharp corner and is therefore indistinct. This can make the measurement of a dimple's diameter somewhat ambiguous.

To resolve this problem, dimple diameter on a finished golf ball is measured according to the method shown in FIG. 1. FIG. 1 shows a dimple half-profile 34, extending from a dimple centerline 31 to the land surface outside of the dimple 33. A ball phantom surface 32 is constructed above the dimple as a continuation of the land surface 33. A first tangent line T1 is then constructed at a point on the dimple sidewall that is spaced 0.003 inches radially inward from the phantom surface 32. The first tangent line T1 intersects the phantom surface 32 at a point P1, which defines a nominal dimple edge position. A second tangent line T2 is then constructed, tangent to the phantom surface 32 at P1. The edge angle is the angle between the first tangent line T1 and the second tangent line T2. The dimple diameter is the distance between P1 and its equivalent point diametrically opposite along the dimple perimeter. Alternatively, it is twice the distance between P1 and the dimple centerline 31, measured in a direction perpendicular to the dimple centerline 31. The dimple depth is the distance measured along a ball radius from the phantom surface 32 of the ball to the deepest point on the dimple. The chord plane runs through the point P1 and is normal to the dimple centerline 31. The chord depth is the distance from the chord plane to the deepest part of the dimple. The cap height is the distance from the chord plane to the phantom surface 32 along the dimple centerline 31. The dimple volume is the space enclosed between the phantom surface 32 and the dimple surface 34 (extended along the first tangent line T1 until it intersects the phantom surface 32).

Figure 2:
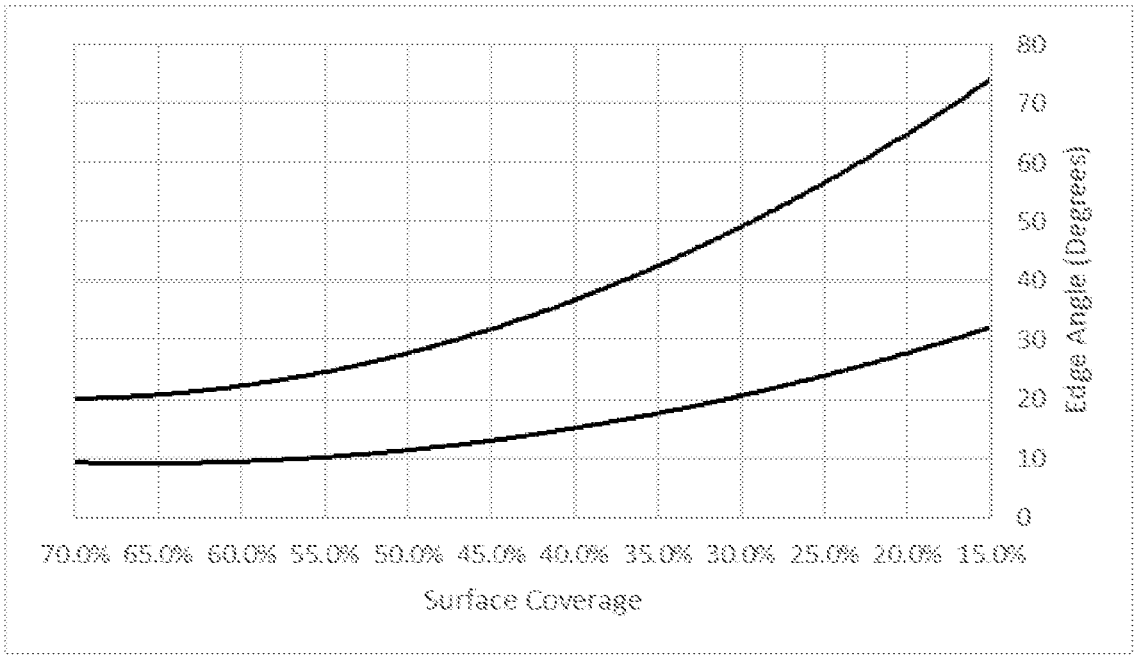
FIG. 2 is a graphical representation of the relationship between edge angle and surface coverage according to one embodiment of the present disclosure.

The dimple patterns of the present disclosure may have varying edge angles depending on the desired surface coverage. Optimization of the edge angles using the equations provided herein can help reduce the flight of the ball while maintaining ideal trajectories. For spherical dimples, the edge angle is defined as the angle between the first tangent line T1 and the second tangent line T2, as shown in FIG. 1. In one embodiment, the average edge angle ($\theta_\mu$) of all the dimple edge angles on the golf ball is related to the surface coverage based on the range displayed in equation (III) below:

$$88.8(SC)^2 - 116.9(SC) + 47.7 \leq \theta_\mu \leq 170.0(SC)^2 - 242.5(SC) + 106.6, \quad \text{(III)}$$

where SC is the surface coverage and the format for SC is the decimal form of percentage (for example, 50 percent coverage is 0.50). FIG. 2 is a graphical representation of the relationship between edge angle and surface coverage of spherical dimples according to an embodiment of the present disclosure. In one embodiment, the dimples of the present disclosure may have any edge angle falling within the range of values shown in FIG. 2. For instance, with a desired surface coverage of about 70 percent, the average edge angle of all the dimple edge angles on the golf ball may range from about 9.38 degrees to about 20.15 degrees. In another embodiment, with a desired surface coverage of about 50 percent, the average edge angle of all the dimple edge angles on the golf ball may range from about 11.45 degrees to about 27.85 degrees. In still another embodiment, with a desired surface coverage of about 30 percent, the average edge angle of all the dimple edge angles on the golf ball may range from about 20.62 degrees to about 49.15 degrees. In yet another embodiment, with a desired surface coverage of about 15 percent, the average edge angle of all the dimple edge angles on the golf ball may range from about 32.16 degrees to about 74.05 degrees. Accordingly, in some embodiments, as the surface coverage of the dimple patterns generated by the present disclosure decreases, the average edge angles may increase.

In one embodiment, the edge angle of all the dimples within a dimple section is substantially the same. For purposes of the present disclosure, edge angles on a finished golf ball are substantially identical if they differ by less than about 0.25 degrees. In another embodiment, the dimples within a dimple section may have two different edge angles. That is, the dimples within a dimple section may have two different edge angles that differ by more than about 0.25 degrees. In still another embodiment, the dimples within a dimple section may have three different edge angles, where each edge angle differs from the others by more than about 0.25 degrees.

In the embodiments where the dimples may have varying edge angles, the maximum difference in edge angle between any two dimples within a dimple section may be about 1 degree to about 4 degrees. In one embodiment, the maximum difference in edge angle between any two dimples within a dimple section may be about 1 degree to about 3 degrees. For example, in a preferred embodiment, the maximum difference in edge angle between any two dimples within a dimple section is about 1 degree.

The spherical dimples contemplated by the present disclosure may also have a dimple depth, chord depth, and cap height, as defined and shown in FIG. 1. In one embodiment, when golf balls of the present disclosure have a desired surface coverage of about 70 percent, the dimple depths may range from about 0.0049 inches to about 0.0146 inches. In another embodiment, when golf balls of the present disclosure have a desired surface coverage of about 50 percent, the dimple depths may range from about 0.0049 inches to about 0.0175 inches. In still another embodiment, when golf balls of the present disclosure have a desired surface coverage of about 30 percent, the dimple depths may range from about 0.0063 inches to about 0.0259 inches. In yet another embodiment, when golf balls of the present disclosure have a desired surface coverage of about 15 percent, the dimple depths may range from about 0.0072 inches to about 0.0369 inches.

Figure 3:
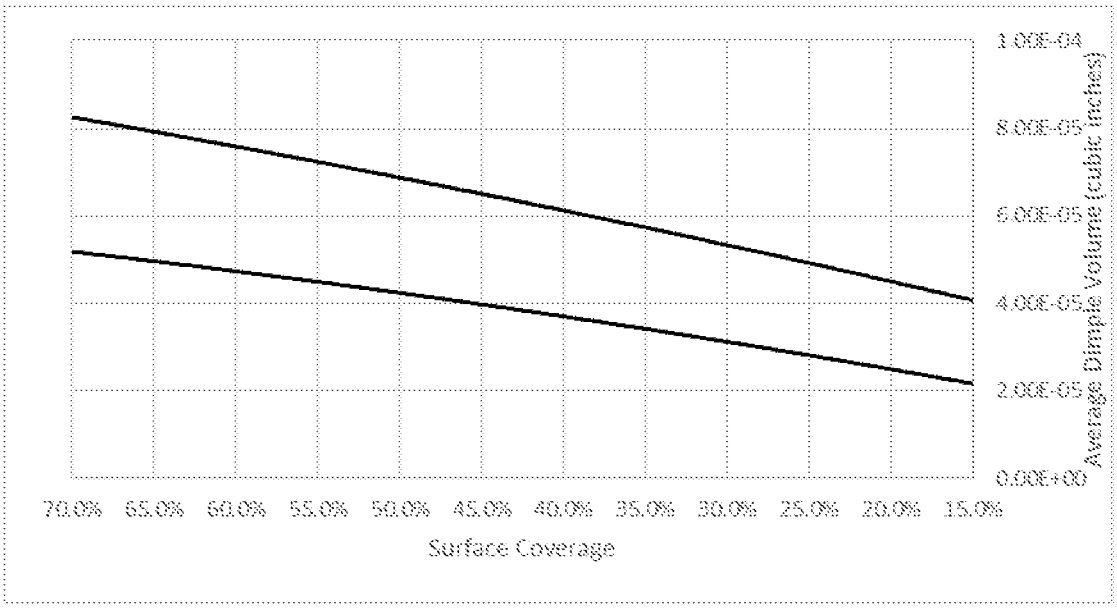
FIG. 3 is a graphical representation of the relationship between average dimple volume and surface coverage according to another embodiment of the present disclosure.

While the dimples have been exemplified herein as having a spherical profile, the dimples may have a variety of other profile shapes as noted above. For non-spherical dimples, the average dimple volume is related to the surface coverage. The "dimple volume" refers to the total volume encompassed by the dimple shape and the phantom surface of the golf ball. In one embodiment, the average dimple volume ($V_\mu$) of all the dimple volumes is related to the surface coverage based on the range displayed in equation (IV) below:

$$-2.2\times10^{-5}(SC)^2 + 7.4\times10^{-5}(SC) + 1.1\times10^{-5} \leq V_\mu \leq -2.0\times10^{-5}(SC)^2 + 9.3\times10^{-5}(SC) + 2.7\times10^{-5}, \quad \text{(IV)}$$

where SC is the surface coverage and the format for SC is the decimal form of percentage, for example, 50 percent is 0.50. FIG. 3 is a graphical representation of the relationship between average dimple volume and surface coverage of non-spherical dimples according to an embodiment of the present disclosure. In one embodiment, the dimples of the present disclosure may have any average dimple volume falling within the range of values shown in FIG. 3. For example, with a desired surface coverage of about 70 percent, the average dimple volume of all the dimple volumes is about $5.20\times10^{-5}$ cubic inches to about $8.23\times10^{-5}$ cubic inches. In another embodiment, with a desired surface coverage of about 50 percent, the average dimple volume of all the dimple volumes is about $4.25\times10^{-5}$ cubic inches to about $6.85\times10^{-5}$ cubic inches. In still another embodiment, with a desired surface coverage of about 30 percent, the average dimple volume of all the dimple volumes is about $3.12\times10^{-5}$ cubic inches to about $5.31\times10^{-5}$ cubic inches. In yet another embodiment, with a desired surface coverage of about 15 percent, the average dimple volume of all the dimple volumes is about $2.16\times10^{-5}$ cubic inches to about $4.05\times10^{-5}$ cubic inches. Accordingly, in some embodiments, as the surface coverage of the dimple patterns generated by the present disclosure decreases, the average dimple volumes may also decrease.

Dimple Count

The dimple count on the golf balls contemplated by the present disclosure may be varied. As used herein, the "dimple count" of a golf ball refers to how many dimples are present on the golf ball. The total number of dimples may be based on, for instance, the number of differently sized dimples, the maximum and minimum diameters of the dimples, the dimple arrangement, and the desired surface coverage.

In one embodiment, the total number of dimples may be less than about 350 dimples. For example, the total number of dimples on the golf ball may be about 312. In another embodiment, the total number of dimples on the golf ball may be about 318. In still another embodiment, the total number of dimples on the golf ball may be about 322. In yet another embodiment, the total number of dimples on the golf ball may be about 326. In another embodiment, the total number of dimples on the golf ball may be about 330. In still another embodiment, the total number of dimples on the golf ball may be about 332. In yet another embodiment, the total number of dimples on the golf ball may be about 338. In another embodiment, the total number of dimples on the golf ball may be about 342.

In another embodiment, the total number of dimples on the golf ball may range from about 350 dimples to about 600 dimples. For instance, the total number of dimples may be about 350 dimples. In another embodiment, the total number of dimples may be about 372 dimples. In still another embodiment, the total number of dimples may be about 392. In yet another embodiment, the total number of dimples may be about 446. In another embodiment, the total number of dimples may be about 566.

Golf Ball Construction

Dimple patterns according to the present disclosure may be used with practically any type of ball construction. For instance, the golf ball may have a two-piece design, a double cover, or veneer cover construction depending on the type of performance desired of the ball. Other suitable golf ball constructions include solid, wound, liquid-filled, and/or dual cores, and multiple intermediate layers.

Different materials may be used in the construction of golf balls according to the present disclosure. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

The golf balls of the present disclosure may be formed using a variety of application techniques. For example, the golf ball layers may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials.

EXAMPLES

The following non-limiting examples demonstrate dimple patterns that may be made in accordance with the present disclosure. The examples are merely illustrative of the preferred embodiments of the present disclosure and are not to be construed as limiting the disclosure, the scope of which is defined by the appended claims.

Example 1

Figure 4:
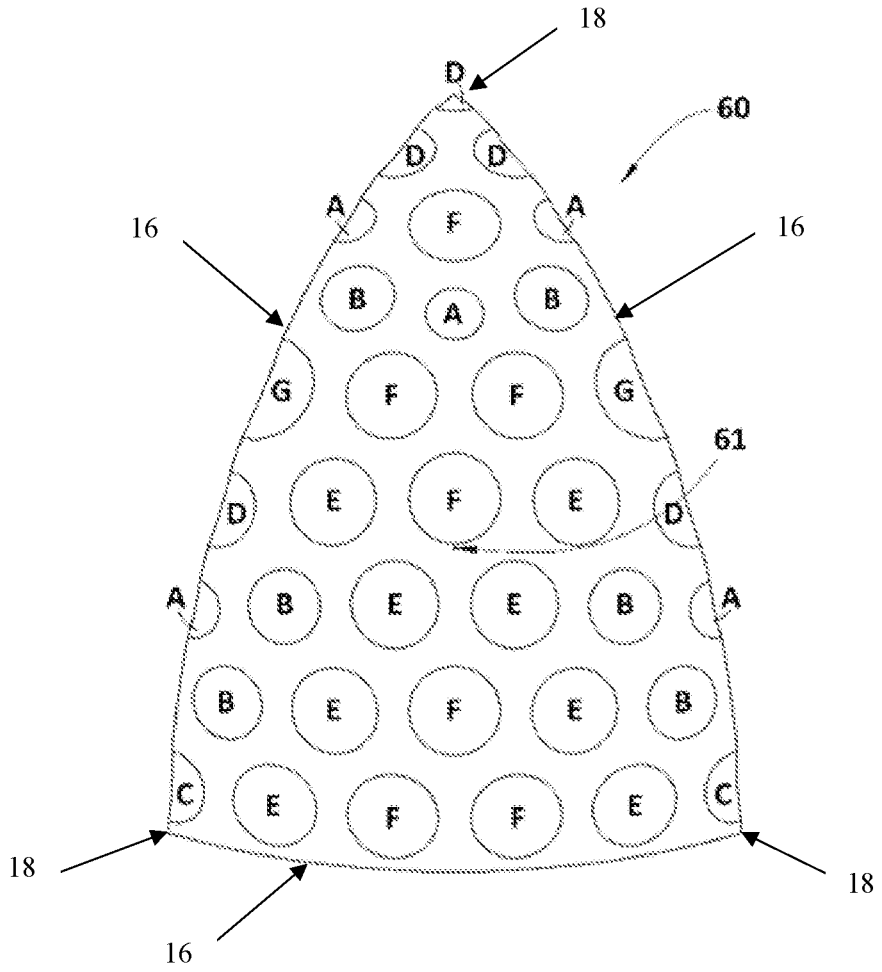
FIG. 4 illustrates a dimple section according to an embodiment of the present disclosure.
Figure 5:
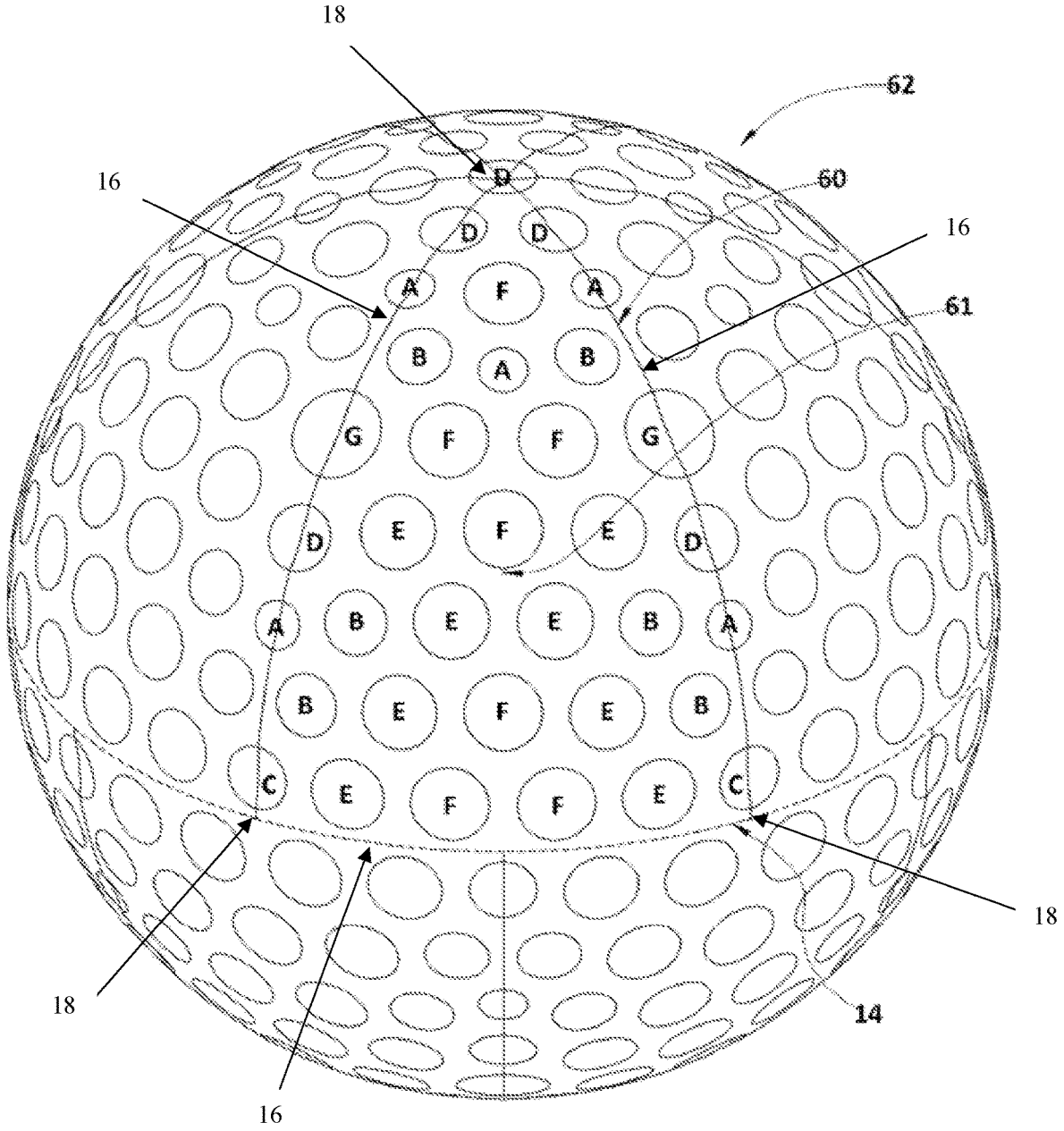
FIG. 5 illustrates a golf ball having a dimple pattern according to the embodiment shown in FIG. 4.

A hexagonal dipyramid dimple pattern according to an embodiment of the present disclosure is illustrated in FIGS. 4 and 5. FIG. 4 shows a spherical triangle 60 packed with dimples and having three edges 16. FIG. 5 shows the spherical triangle 60 of FIG. 4 patterned around a golf ball 62. The golf ball 62 has twelve spherical triangles 60 packed with the same dimple pattern shown in FIG. 4. The golf ball 62 has a diameter of 1.68 inches and the resulting overall dimple pattern has a total of 338 dimples with a surface coverage of about 45.1 percent. The dotted line identifies the only dimple free great circle 14 on the surface of the golf ball 62.

In FIGS. 4 and 5, the alphabetic labels within the dimples designate dimples having substantially the same dimple measurements, for instance, substantially the same diameter, depth, chord depth, cap height, and edge angle. In the illustrated embodiment shown in FIGS. 4 and 5, the dimples labeled A-G have the diameters, depths, chord depths, cap heights, and edge angles given in Table 1 below:

TABLE 1

Dimple Measurements of FIGS. 4 and 5

| Dimple | Dimple Diameter (inches) | Dimple Depth (inches) | Chord Depth (inches) | Cap Height (inches) | Edge Angle (degrees) |
|---|---|---|---|---|---|
| A | 0.085 | 0.0082 | 0.0072 | 0.0011 | 22.00 |
| B | 0.110 | 0.0106 | 0.0088 | 0.0018 | 22.00 |
| C | 0.115 | 0.0111 | 0.0091 | 0.0020 | 22.00 |
| D | 0.124 | 0.0120 | 0.0097 | 0.0023 | 22.00 |
| E | 0.129 | 0.0125 | 0.0100 | 0.0025 | 22.00 |
| F | 0.134 | 0.0129 | 0.0103 | 0.0027 | 22.00 |
| G | 0.160 | 0.0154 | 0.0116 | 0.0038 | 22.00 |

As shown in FIGS. 4 and 5 and Table 1, the dimples have a total of seven different dimple diameters, including a minimum dimple diameter of about 0.085 inches (represented by dimples labeled "A"), a maximum dimple diameter of about 0.160 inches (represented by dimples labeled "G"), and five additional dimple diameters of about 0.110 inches (represented by dimples labeled "B"), of about 0.115 inches (represented by dimples labeled "C"), of about 0.124 inches (represented by dimples labeled "D"), of about 0.129 inches (represented by dimples labeled "E"), and of about 0.134 inches (represented by dimples labeled "F"). The maximum difference between any two dimple diameters is about 0.075 inches. All the dimples have the same edge angle of about 22.00 degrees.

The dimples are arranged within each spherical triangle 60 such that some dimples, for example, a number of dimples labeled "A", "C", "D", and "G" intersect two of the edges 16 of the spherical triangle 60 (i.e., the two side edges). The edges 16 run through the centroids of the intersecting "A", "C", "D", and "G" dimples. Also shown in the illustrated embodiment, a dimple labeled "D" lies at a single vertex 18 of the spherical triangle 60 (i.e., the top vertex). The dimple located at the vertex 18 is centered such that a portion of the dimple is located within six of the spherical triangles 60. The resulting dimple pattern has no rotational symmetry about an axis connecting the center of the golf ball and the center 61 of the spherical triangle 60.

Example 2

Figure 6:
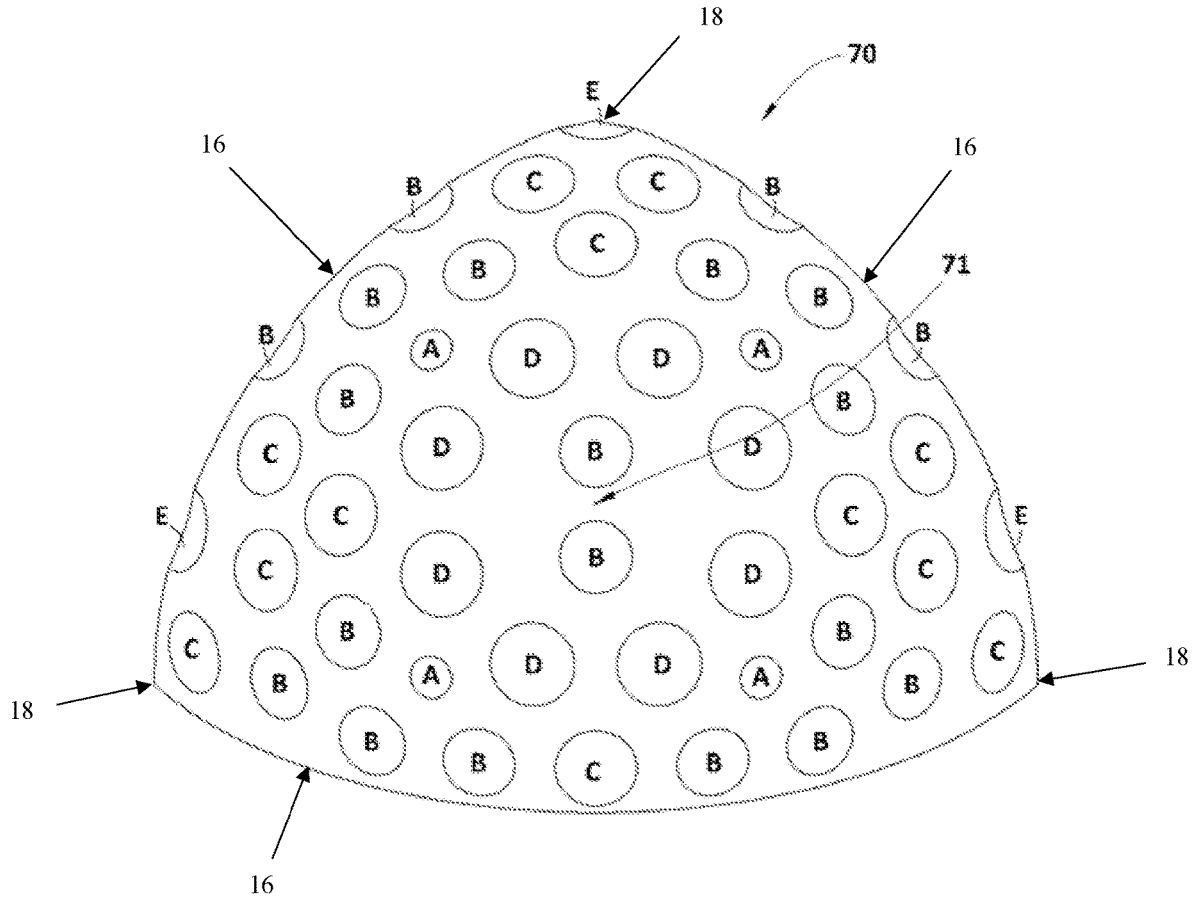
FIG. 6 illustrates a dimple section according to another embodiment of the present disclosure.
Figure 7:
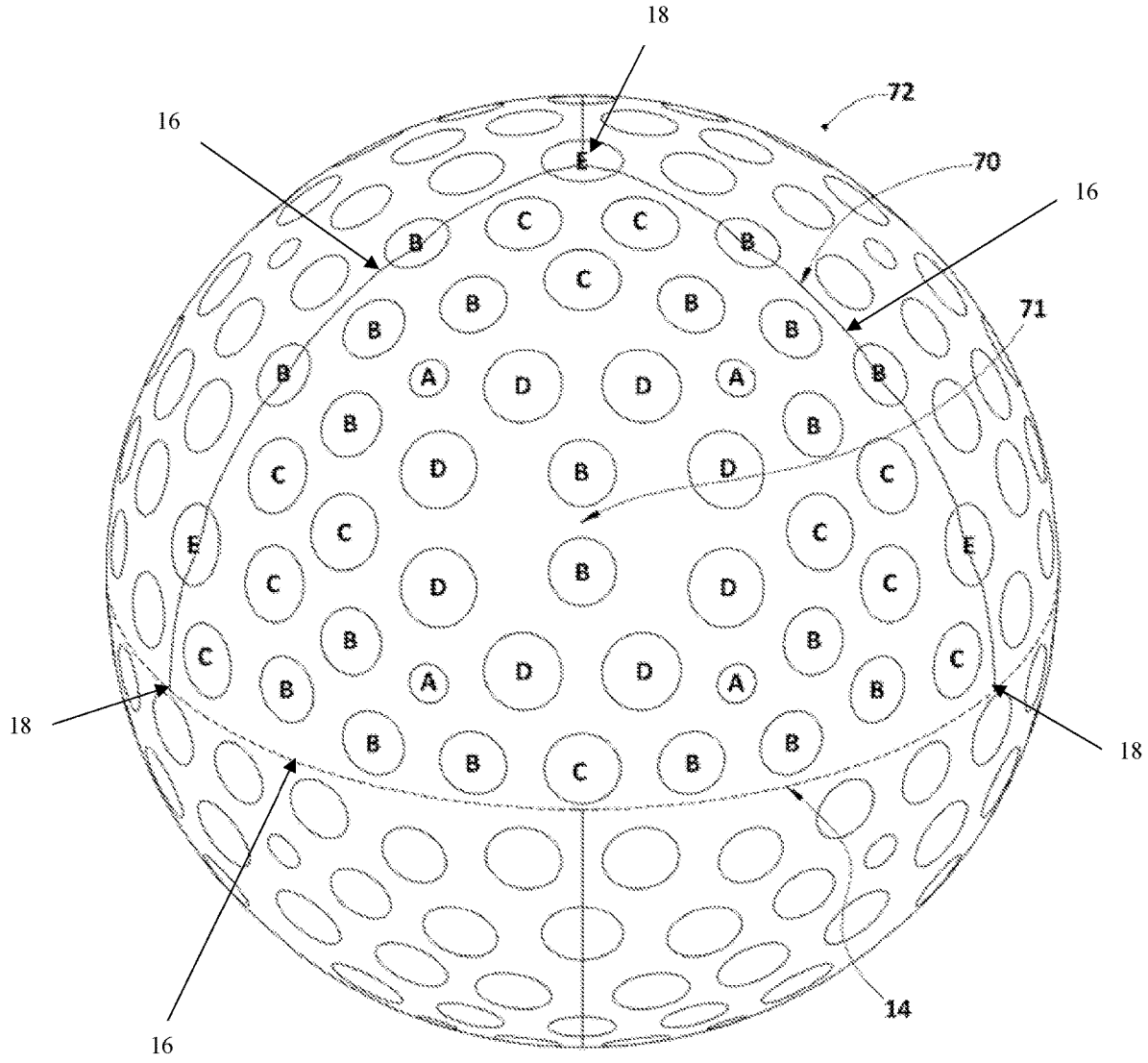
FIG. 7 illustrates a golf ball having a dimple pattern according to the embodiment shown in FIG. 6.

A triangular dipyramid dimple pattern according to an embodiment of the present disclosure is illustrated in FIGS. 6 and 7. FIG. 6 shows a spherical triangle 70 packed with dimples and having three edges 16. FIG. 7 shows the spherical triangle 70 of FIG. 4 patterned around a golf ball 72. The golf ball 72 has six spherical triangles 70 packed with the same dimple pattern shown in FIG. 6. The golf ball 72 has a diameter of 1.68 inches and the resulting overall dimple pattern has a total of 260 dimples with a surface coverage of about 36.9 percent. The dotted line identifies the only dimple free great circle 14 on the surface of the golf ball 72.

In FIGS. 6 and 7, the alphabetic labels within the dimples designate dimples having substantially the same dimple measurements, for instance, substantially the same diameter, depth, chord depth, cap height, and edge angle. In the illustrated embodiment shown in FIGS. 6 and 7, the dimples labeled A-E have the diameters, depths, chord depths, cap heights, and edge angles given in Table 2 below:

TABLE 2

Dimple Measurements of FIGS. 6 and 7

| Dimple | Dimple Diameter (inches) | Dimple Depth (inches) | Chord Depth (inches) | Cap Height (inches) | Edge Angle (degrees) |
|---|---|---|---|---|---|
| A | 0.072 | 0.0096 | 0.0088 | 0.0008 | 30.00 |
| B | 0.121 | 0.0161 | 0.0139 | 0.0022 | 30.00 |
| C | 0.136 | 0.0181 | 0.0153 | 0.0028 | 30.00 |
| D | 0.141 | 0.0187 | 0.0157 | 0.0030 | 30.00 |
| E | 0.146 | 0.0194 | 0.0162 | 0.0032 | 30.00 |

As shown in FIGS. 6 and 7 and Table 2, the dimples have a total of five different dimple diameters, including a minimum dimple diameter of about 0.072 inches (represented by dimples labeled "A"), a maximum dimple diameter of about 0.146 inches (represented by dimples labeled "E"), and three additional dimple diameters of about 0.121 inches (represented by dimples labeled "B"), of about 0.136 inches (represented by dimples labeled "C"), and of about 0.141 inches (represented by dimples labeled "D"). The maximum difference between any two dimple diameters is about 0.074 inches. All the dimples have the same edge angle of about 30.00 degrees.

The dimples are arranged within each spherical triangle 70 such that some dimples, for example, a number of dimples labeled "B" and "E" intersect two of the edges 16 of the spherical triangle 70 (i.e., the two side edges). The edges 16 run through the centroids of the intersecting "B" and "E" dimples. Also shown in the illustrated embodiment, a dimple labeled "E" lies at a single vertex 18 of the spherical triangle 70 (i.e., the top vertex). The dimple located at the vertex 18 is centered such that a portion of the dimple is located within three of the spherical triangles 70. The resulting dimple pattern has no rotational symmetry about an axis connecting the center of the golf ball and the center 71 of the spherical triangle 70.

Example 3

Figure 8:
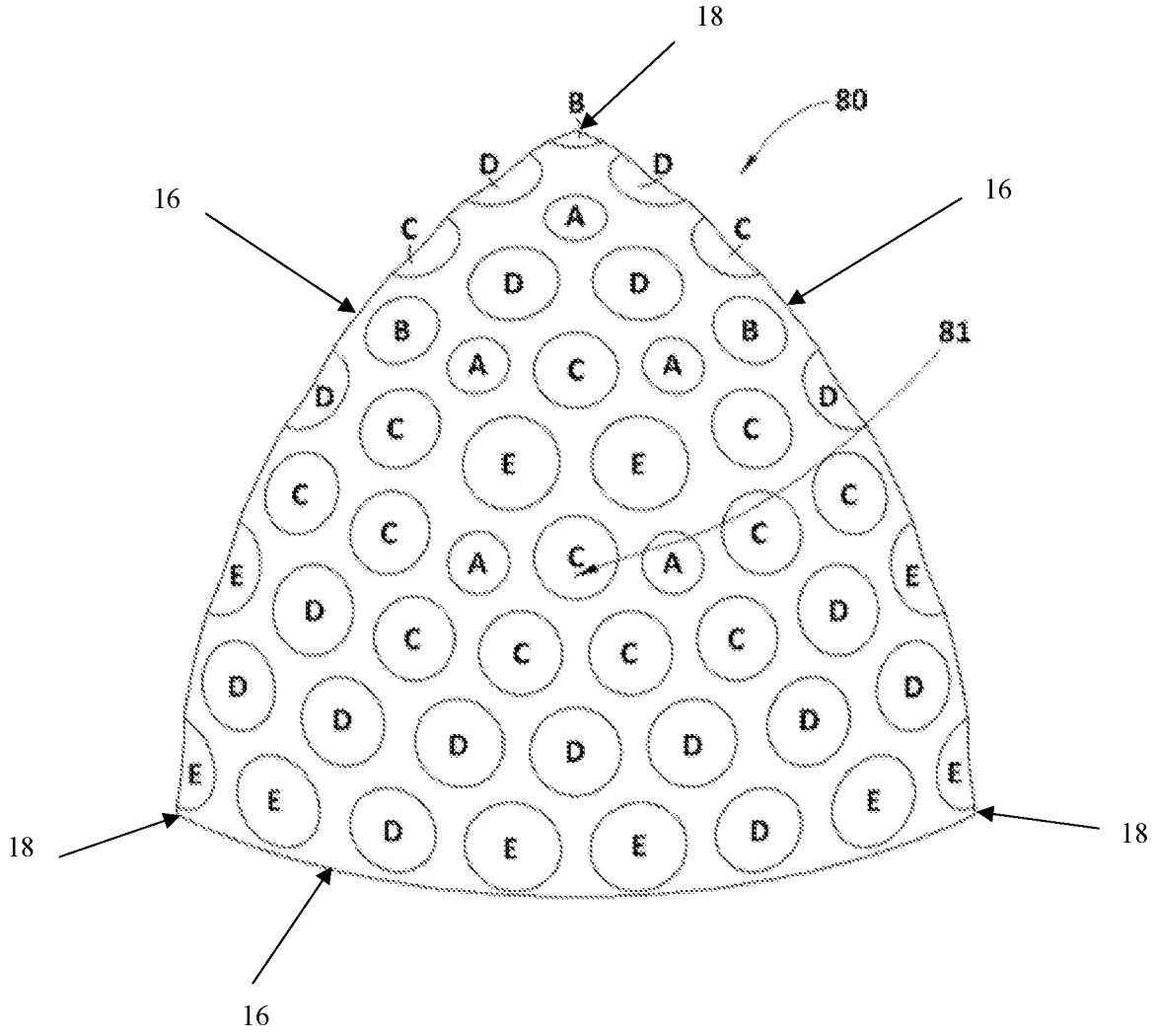
FIG. 8 illustrates a dimple section according to still another embodiment of the present disclosure.
Figure 9:
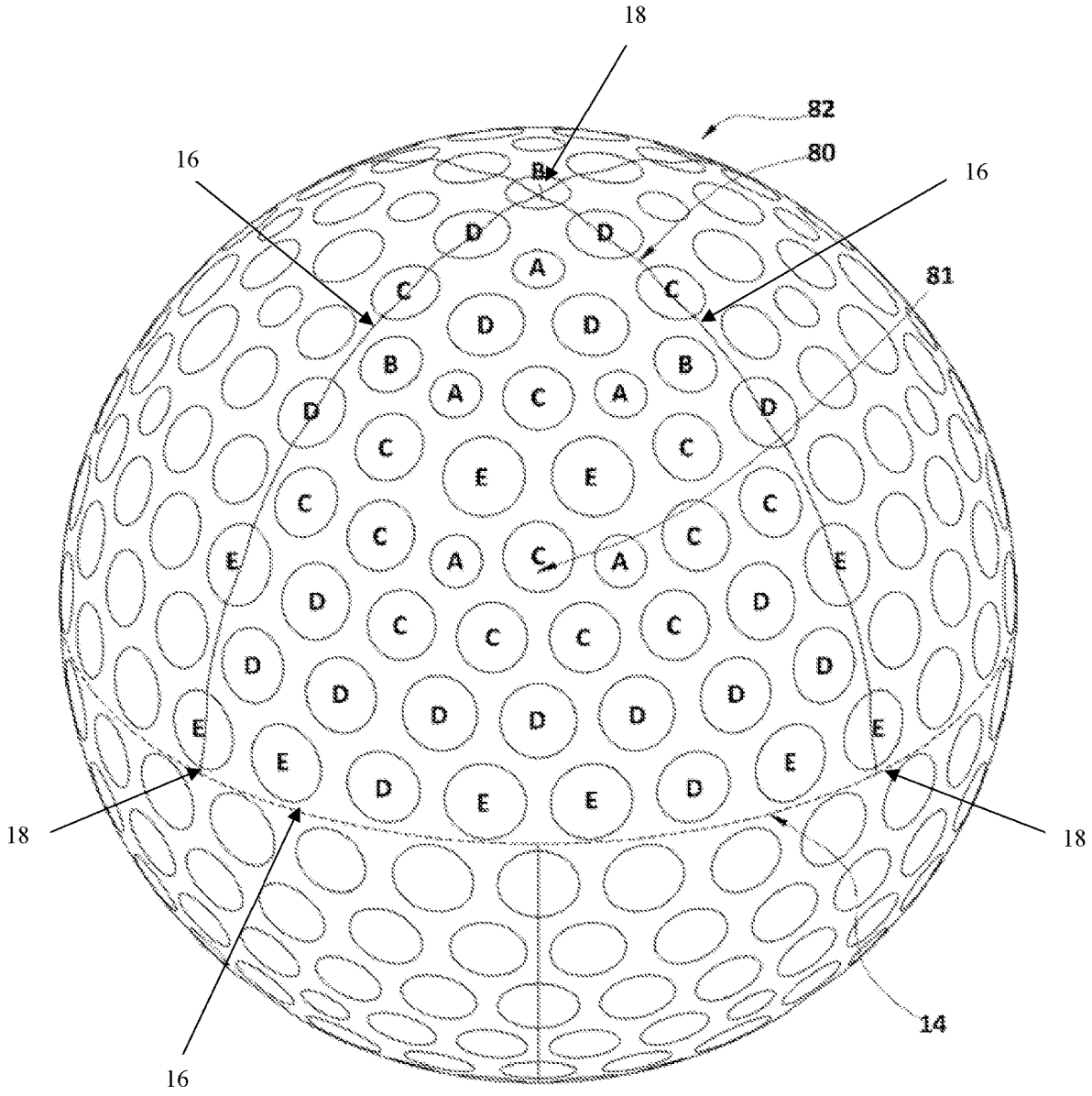
FIG. 9 illustrates a golf ball having a dimple pattern according to the embodiment shown in FIG. 8.

A quadrilateral dipyramid dimple pattern according to an embodiment of the present disclosure is illustrated in FIGS. 8 and 9. FIG. 8 shows a spherical triangle 80 packed with dimples and having three edges 16. FIG. 9 shows the spherical triangle 80 of FIG. 8 patterned around a golf ball 82. The golf ball 82 has eight spherical triangles 80 packed with the same dimple pattern shown in FIG. 8. The golf ball 82 has a diameter of 1.68 inches and the resulting overall dimple pattern has a total of 346 dimples with a surface coverage of about 50.9 percent. The dotted line identifies the only dimple free great circle 14 on the surface of the golf ball 82.

In FIGS. 8 and 9, the alphabetic labels within the dimples designate dimples having substantially the same dimple measurements, for instance, substantially the same diameter, depth, chord depth, cap height, and edge angle. In the illustrated embodiment shown in FIGS. 8 and 9, the dimples labeled A-E have the diameters, depths, chord depths, cap heights, and edge angles given in Table 3 below:

TABLE 3

Dimple Measurements of FIGS. 8 and 9

| Dimple | Dimple Diameter (inches) | Dimple Depth (inches) | Chord Depth (inches) | Cap Height (inches) | Edge Angle (degrees) |
|---|---|---|---|---|---|
| A | 0.093 | 0.0078 | 0.0065 | 0.0013 | 19.00 |
| B | 0.115 | 0.0096 | 0.0076 | 0.0020 | 19.00 |
| C | 0.125 | 0.0104 | 0.0081 | 0.0023 | 19.00 |
| D | 0.135 | 0.0112 | 0.0085 | 0.0027 | 19.00 |
| E | 0.145 | 0.0121 | 0.0089 | 0.0031 | 19.00 |

As shown in FIGS. 8 and 9 and Table 3, the dimples have a total of five different dimple diameters, including a minimum dimple diameter of about 0.093 inches (represented by dimples labeled "A"), a maximum dimple diameter of about 0.145 inches (represented by dimples labeled "E"), and three additional dimple diameters of about 0.115 inches (represented by dimples labeled "B"), of about 0.125 inches (represented by dimples labeled "C"), and of about 0.135 inches (represented by dimples labeled "D"). The maximum difference between any two dimple diameters is about 0.052 inches. All the dimples have the same edge angle of about 19.00 degrees.

The dimples are arranged within each spherical triangle 80 such that some dimples, for example, a number of dimples labeled "C", "D", and "E" intersect two of the edges 16 of the spherical triangle 80 (i.e., the two side edges). The edges 16 run through the centroids of the intersecting "C", "D", and "E" dimples. Also shown in the illustrated embodiment, a dimple labeled "B" lies at a single vertex 18 of the spherical triangle 80 (i.e., the top vertex). The dimple located at the vertex 18 is centered such that a portion of the dimple is located within four of the spherical triangles 80. The resulting dimple pattern has no rotational symmetry about an axis connecting the center of the golf ball and the center 81 of the spherical triangle 80.

Example 4

Figure 10:
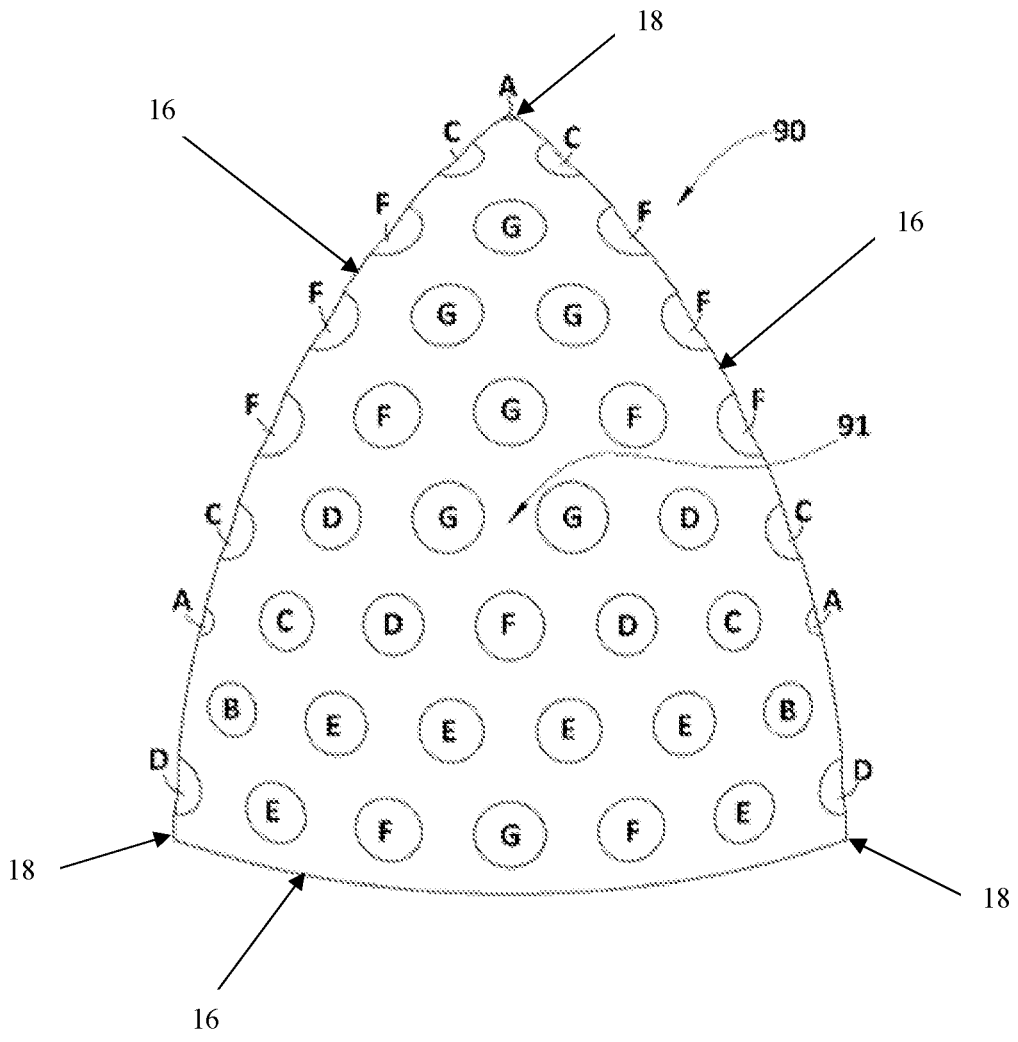
FIG. 10 illustrates a dimple section according to yet another embodiment of the present disclosure.
Figure 11:
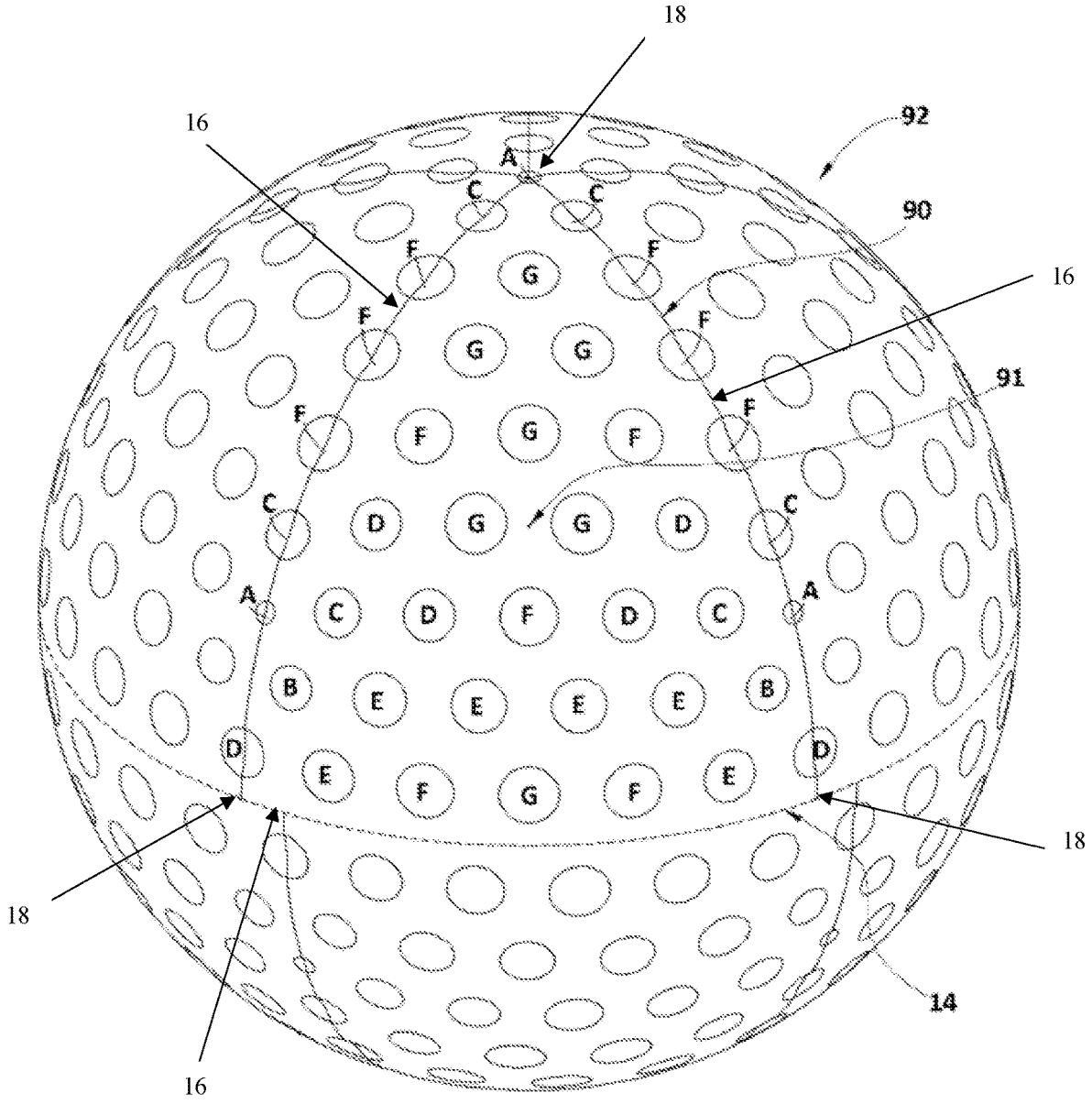
FIG. 11 illustrates a golf ball having a dimple pattern according to the embodiment shown in FIG. 10.

A pentagonal dipyramid dimple pattern according to an embodiment of the present disclosure is illustrated in FIGS. 10 and 11. FIG. 10 shows a spherical triangle 90 packed with dimples and having three edges 16. FIG. 11 shows the spherical triangle 90 of FIG. 10 patterned around a golf ball 92. The golf ball 92 has ten spherical triangles 90 packed with the same dimple pattern shown in FIG. 10. The golf ball 92 has a diameter of 1.68 inches and the resulting overall dimple pattern has a total of 332 dimples with a surface coverage of about 26.2 percent. The dotted line identifies the only dimple free great circle 14 on the surface of the golf ball 92.

In FIGS. 10 and 11, the alphabetic labels within the dimples designate dimples having substantially the same dimple measurements, for instance, substantially the same diameter, depth, chord depth, cap height, and edge angle. In the illustrated embodiment shown in FIGS. 10 and 11, the dimples labeled A-G have the diameters, depths, chord depths, cap heights, and edge angles given in Table 4 below:

TABLE 4

Dimple Measurements of FIGS. 10 and 11

| Dimple | Dimple Diameter (inches) | Dimple Depth (inches) | Chord Depth (inches) | Cap Height (inches) | Edge Angle (degrees) |
|---|---|---|---|---|---|
| A | 0.040 | 0.0071 | 0.0068 | 0.0002 | 39.00 |
| B | 0.080 | 0.0141 | 0.0131 | 0.0010 | 39.00 |
| C | 0.085 | 0.0149 | 0.0139 | 0.0011 | 39.00 |
| D | 0.090 | 0.0158 | 0.0146 | 0.0012 | 39.00 |
| E | 0.095 | 0.0167 | 0.0153 | 0.0013 | 39.00 |
| F | 0.100 | 0.0175 | 0.0160 | 0.0015 | 39.00 |
| G | 0.105 | 0.0184 | 0.0168 | 0.0016 | 39.00 |

As shown in FIGS. 10 and 11 and Table 4, the dimples have a total of seven different dimple diameters, including a minimum dimple diameter of about 0.040 inches (represented by dimples labeled "A"), a maximum dimple diameter of about 0.105 inches (represented by dimples labeled "G"), and five additional dimple diameters of about 0.080 inches (represented by dimples labeled "B"), of about 0.085 inches (represented by dimples labeled "C"), of about 0.090 inches (represented by dimples labeled "D"), of about 0.095 inches (represented by dimples labeled "E"), and of about 0.100 inches (represented by dimples labeled "F"). The maximum difference between any two dimple diameters is about 0.065 inches. All the dimples have the same edge angle of about 39.00 degrees.

The dimples are arranged within each spherical triangle 90 such that some dimples, for example, a number of dimples labeled "A", "C", "D", and "F" intersect two of the edges 16 of the spherical triangle 90 (i.e., the two side edges). The edges 16 run through the centroids of the intersecting "A", "C", "D", and "F" dimples. Also shown in the illustrated embodiment, a dimple labeled "A" lies at a single vertex 18 of the spherical triangle 90 (i.e., the top vertex). The dimple located at the vertex 18 is centered such that a portion of the dimple is located within five of the spherical triangles 90. The resulting dimple pattern has no rotational symmetry about an axis connecting the center of the golf ball and the center 91 of the spherical triangle 90.

The golf balls and dimple patterns described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A golf ball having a dimple pattern disposed on a substantially spherical phantom surface, the phantom surface having a radius that is equal at all points along the circumference of the golf ball, wherein the dimple pattern comprises:

a plurality of dimples arranged in a dipyramid pattern consisting of ten substantially identical dimple sections, wherein each dimple section is defined by a spherical triangle, wherein the dimples in each of the substantially identical dimple sections comprise at least two different dimple diameters including a minimum dimple diameter equivalent to the smallest dimple diameter within the dimple section and a maximum dimple diameter, wherein each of the substantially identical dimple sections comprises a dimple located on at least one vertex and the dimple located on the at least one vertex has the minimum dimple diameter, and wherein the dimples cover less than 70 percent of the substantially spherical phantom surface, and wherein the pattern results in one dimple free great circle on the golf ball.

2. The golf ball of claim 1, wherein the dipyramid pattern is a pentagonal dipyramid pattern.

3. The golf ball of claim 1, wherein each of the at least two different dimple diameters range from about 0.030 inches to about 0.200 inches.

4. The golf ball of claim 1, wherein the pattern has mirror symmetry about a central plane of each substantially identical dimple section.

5. The golf ball of claim 1, wherein the dimples each have a corresponding edge angle and the average of all the edge angles ($\theta_\mu$) is related to the surface coverage according to equation (III):

$$88.8(SC)^2 - 116.9(SC) + 47.7 \le \theta_\mu \le 170.0(SC)^2 - 242.5(SC) + 106.6, \quad \text{(III)}$$

where SC is the surface coverage.

6. The golf ball of claim 1, wherein each substantially identical dimple section further comprises a dimple having a centroid that intersects a side edge of the dimple section.

7. A golf ball having a dimple pattern disposed on a substantially spherical phantom surface, the phantom surface having a radius that is equal at all points along the circumference of the golf ball, wherein the dimple pattern comprises:

a plurality of dimples arranged in a pentagonal dipyramid pattern, the pentagonal dipyramid pattern consisting of ten substantially identical dimple sections, wherein each dimple section is defined by a spherical triangle having three vertices, wherein the dimples in each of the substantially identical dimple sections have a corresponding dimple diameter and a corresponding edge angle, wherein the dimples in each of the substantially identical dimple sections comprise:

(i) at least three different dimple diameters including a minimum dimple diameter equivalent to the smallest dimple diameter within the dimple section, a maximum dimple diameter, and at least one additional dimple diameter, wherein each of the at least three different dimple diameters range from about 0.030 inches to about 0.200 inches, and (ii) substantially identical edge angles, wherein each of the substantially identical dimple sections comprises a dimple located on at least one vertex and the dimple located on the at least one vertex has the minimum dimple diameter, and wherein the dimples cover less than 70 percent of the substantially spherical phantom surface.

8. The golf ball of claim 7, wherein each substantially identical dimple section further comprises a dimple having a centroid that intersects a side edge of the dimple section.

9. The golf ball of claim 7, wherein the pattern results in one dimple free great circle on the golf ball.

10. The golf ball of claim 7, wherein the average of all the edge angles ($\theta_\mu$) is related to the surface coverage according to equation (III):

$$88.8(SC)^2 - 116.9(SC) + 47.7 \leq \theta_\mu \leq 170.0(SC)^2 - 242.5(SC) + 106.6, \quad \text{(III)}$$

where SC is the surface coverage.

11. The golf ball of claim 7, wherein the maximum difference in diameter between any two dimples within each dimple section is about 0.080 inches or less.

12. The golf ball of claim 7, wherein the pattern has mirror symmetry about a central plane of each substantially identical dimple section.

13. A golf ball having a dimple pattern disposed on a substantially spherical phantom surface, the phantom surface having a radius that is equal at all points along the circumference of the golf ball, wherein the dimple pattern comprises:

a plurality of dimples disposed thereon, wherein the dimples are arranged in a pentagonal dipyramid pattern, the pentagonal dipyramid pattern consisting of ten substantially identical dimple sections, wherein each dimple section is defined by a spherical triangle, wherein the dimples in each of the substantially identical dimple sections have a corresponding dimple diameter and a corresponding edge angle, wherein the dimples in each of the substantially identical dimple sections comprise five or more different dimple diameters including a minimum dimple diameter equivalent to the smallest dimple diameter within the dimple section, a maximum dimple diameter, and at least three additional dimple diameters, wherein each of the five or more different dimple diameters range from about 0.030 inches to about 0.180 inches and differ by more than 0.005 inches, wherein each of the substantially identical dimple sections comprises a dimple located on at least one vertex and the dimple located on the at least one vertex has the minimum dimple diameter, and wherein the dimples cover less than 70 percent of the substantially spherical phantom surface and the pattern results in one dimple free great circle on the golf ball.

14. The golf ball of claim 13, wherein the dimples in each of the substantially identical dimple sections comprise substantially identical edge angles.

15. The golf ball of claim 13, wherein the average of all the edge angles ($\theta_\mu$) is related to the surface coverage according to equation (III):

$$88.8(SC)^2 - 116.9(SC) + 47.7 \leq \theta_\mu \leq 170.0(SC)^2 - 242.5(SC) + 106.6, \quad \text{(III)}$$

where SC is the surface coverage.

16. The golf ball of claim 13, wherein each substantially identical dimple section further comprises a dimple having a centroid that intersects a side edge of the dimple section.

17. The golf ball of claim 13, wherein the dimples cover less than about 50 percent of the substantially spherical exterior surface.

18. The golf ball of claim 13, wherein the pattern has mirror symmetry about a central plane of each substantially identical dimple section.

19. The golf ball of claim 1, wherein the dimples cover less than 60 percent of the substantially spherical phantom surface.

* * * * *